US009360253B2

(12) United States Patent
Peterman et al.

(10) Patent No.: US 9,360,253 B2
(45) Date of Patent: Jun. 7, 2016

(54) METAL KILN TEMPERATURE CONTROL SYSTEM AND METHOD

(71) Applicants: John M. Peterman, Weldon Spring, MO (US); Mark A. Roberts, St. Charles, MO (US)

(72) Inventors: John M. Peterman, Weldon Spring, MO (US); Mark A. Roberts, St. Charles, MO (US)

(73) Assignee: GILLESPIE + POWERS, INC, St. Louis, MO (US)

( * ) Notice: Subject to any disclaimer, the term of this patent is extended or adjusted under 35 U.S.C. 154(b) by 572 days.

(21) Appl. No.: 13/684,478

(22) Filed: Nov. 23, 2012

(65) Prior Publication Data

US 2014/0147799 A1 May 29, 2014

(51) Int. Cl.

| | |
|---|---|
| ***F27B 7/42*** | (2006.01) |
| ***F27B 7/32*** | (2006.01) |
| ***F27B 7/33*** | (2006.01) |
| ***F27B 7/34*** | (2006.01) |
| ***F27D 17/00*** | (2006.01) |

(52) U.S. Cl.

CPC ... *F27B 7/42* (2013.01); *F27B 7/32* (2013.01); *F27B 7/33* (2013.01); *F27B 7/34* (2013.01); *F27D 17/004* (2013.01)

(58) Field of Classification Search

USPC ..... 432/36, 72, 106, 110, 103, 128

See application file for complete search history.

(56) References Cited

U.S. PATENT DOCUMENTS 3,578,299 A * 5/1971 Hurlbut ..... F27B 7/42 34/539

3,659,829 A * 5/1972 Pospisil ..... F27B 7/42 432/17

(Continued)

FOREIGN PATENT DOCUMENTS

| | | |
|---|---|---|
| JP | 2001004283 A | 1/2001 |
| JP | 2001280849 | 10/2001 |
| JP | 2003176985 | 6/2003 |

OTHER PUBLICATIONS

PCT International Search Report dated Dec. 9, 2011, for the International Application No. PCT/US2011/037163, International Filing Date May 19, 2011.

(Continued)

*Primary Examiner* — Alissa Tompkins
*Assistant Examiner* — Nathaniel Herzfeld
(74) *Attorney, Agent, or Firm* — Polster, Lieder, Woodruff & Lucchesi, LC

(57) ABSTRACT

A rotary aluminum kiln temperature regulation system comprising a temperature sensing device in the kiln that is configured to take temperature readings in an area of the kiln in proximity to the temperature sensing device. The system including a wireless transmitter operatively associated with the temperature sensing device and a receiver wirelessly associated with the transmitter, such that the transmitter and receiver wirelessly transmit the temperature readings taken by the temperature sensing device from the transmitter to the receiver. The system also including a control unit operatively connected to the receiver that is configured to receive the transmitted temperature readings and determine when the transmitted temperature readings exceed a predefined temperature set point. The control unit operatives one or more forward feed control loop subsystems that assist in safely operating the kiln in accord with a predetermined temperature profile programmed into the control unit.

30 Claims, 7 Drawing Sheets

(56) References Cited

U.S. PATENT DOCUMENTS

| | | | | |
|---|---|---|---|---|
| 5,437,707 | A * | 8/1995 | Cross | 75/474 |
| 5,523,957 | A * | 6/1996 | Perron et al. | 700/274 |
| 5,711,018 | A * | 1/1998 | Hittner | A62D 3/32 423/111 |
| 6,227,847 | B1 * | 5/2001 | Gillespie | 432/72 |
| 2006/0088455 | A1 * | 4/2006 | Jones | 422/198 |
| 2011/0287375 | A1 | 11/2011 | Peterman et al. | |

OTHER PUBLICATIONS

PCT Written Opinion of the International Searching Authority dated Dec. 9, 2011, for the International Application No. PCT/US2011/037163, International Filing Date May 19, 2011.

* cited by examiner

METAL KILN TEMPERATURE CONTROL SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates principally to a metal furnace or kiln, and more particularly to a temperature sensing and control system and method for rotary aluminum delacquering kilns using wireless thermocouples or comparable temperature sensing devices.

It has for some time been a standard practice to recycle scrap metals, and in particular scrap aluminum. Various furnace and kiln systems exist that are designed to recycle and recover aluminum from various sources of scrap, such as used beverage cans ("UBC"), siding, windows and door frames, etc. One of the first steps in these processes is to use a rotary kiln to remove the paints, oils, and other surface materials on the scrap aluminum (i.e. "feed material"). This is commonly known in the industry as "delacquering." Delacquering is typically performed in an atmosphere with reduced oxygen levels and temperatures in excess of 900 degrees Fahrenheit. The temperature at which the paints and oils and other surface materials are released from the aluminum scrap in the form of unburned volatile gases is known as the "volatilization point." One such typical aluminum recycling system utilizes a rotary kiln to delacquer the aluminum. Many of these systems utilize a recirculating heat apparatus comprising a burner with a blower to direct heat into the kiln, and a recovery device that collects exhaust heat from the kiln and recirculates the recovered heat into the heat flow for the kiln.

Due to the difficulties in accessing the rotating material during operation, the temperatures in traditional rotary aluminum kilns are not regularly monitored. Sensing devices external of the kiln are sometimes used as a temperature testing method. This requires manual intervention and is not particularly accurate. Unfortunately, failure to consistently and accurately monitor the conditions in the kiln can lead to fires. These fires result when the feed material reaches the volatilization point too rapidly and the feed material begins to rapidly oxidize and generate its own heat, leading to a high temperature excursion (i.e. "overtemp event"). Applicants have learned through tests, utilizing wireless high temperature thermocouples placed in the kiln, that certain temperature profiles occur in the feed material that can be used as precursors to predict such high temperature excursions or overtemp events, and that such events can arise in as little as 10 minutes of operation and can arise in different locations within the kiln. Further, applicants have learned through testing that controlling the heat flow into the kiln can regulate and prevent such overtemp events. These overtemp events can occur at different positions along the length of the feed material in the kiln, and may be affected by such variables as the size of the feed material put into the kiln, the moisture content of the feed material, the volume of the feed material and the feed rate, the composition of the feed material, and the cleanliness of feed material. A fire in a rotary aluminum kiln can require a costly shut-down, will likely destroy the feed material, and can damage the kiln and other associated equipment.

One example of a condition that can lead to an overtemp event concerns the presence of magnesium in aluminum feed material. Most aluminum cans (e.g. UBC's) have lids or tops that comprise a higher percentage of magnesium than the body of the can. Magnesium melts at a lower temperature than aluminum, and is very combustive. When placed in a rotary aluminum kiln, the aluminum can lids can separate from the aluminum can body. This is known in the industry as "lid fracturing". This lid fracturing reduces the lids to particles of aluminum and magnesium as small as a grain of sand. Oxidation of these particles in the kiln occurs very rapidly, resulting in highly combustible partially oxidized aluminum and magnesium. In such circumstances, the amount of heat in the kiln must be reduced or the partially oxidized aluminum and magnesium can accelerate in temperature and ignite in the kiln. Like other overtemp events, such UBC lids fracture events can be localized to one or more Zones within the kiln. However, once ignition occurs the fire can flash rapidly throughout the kiln.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
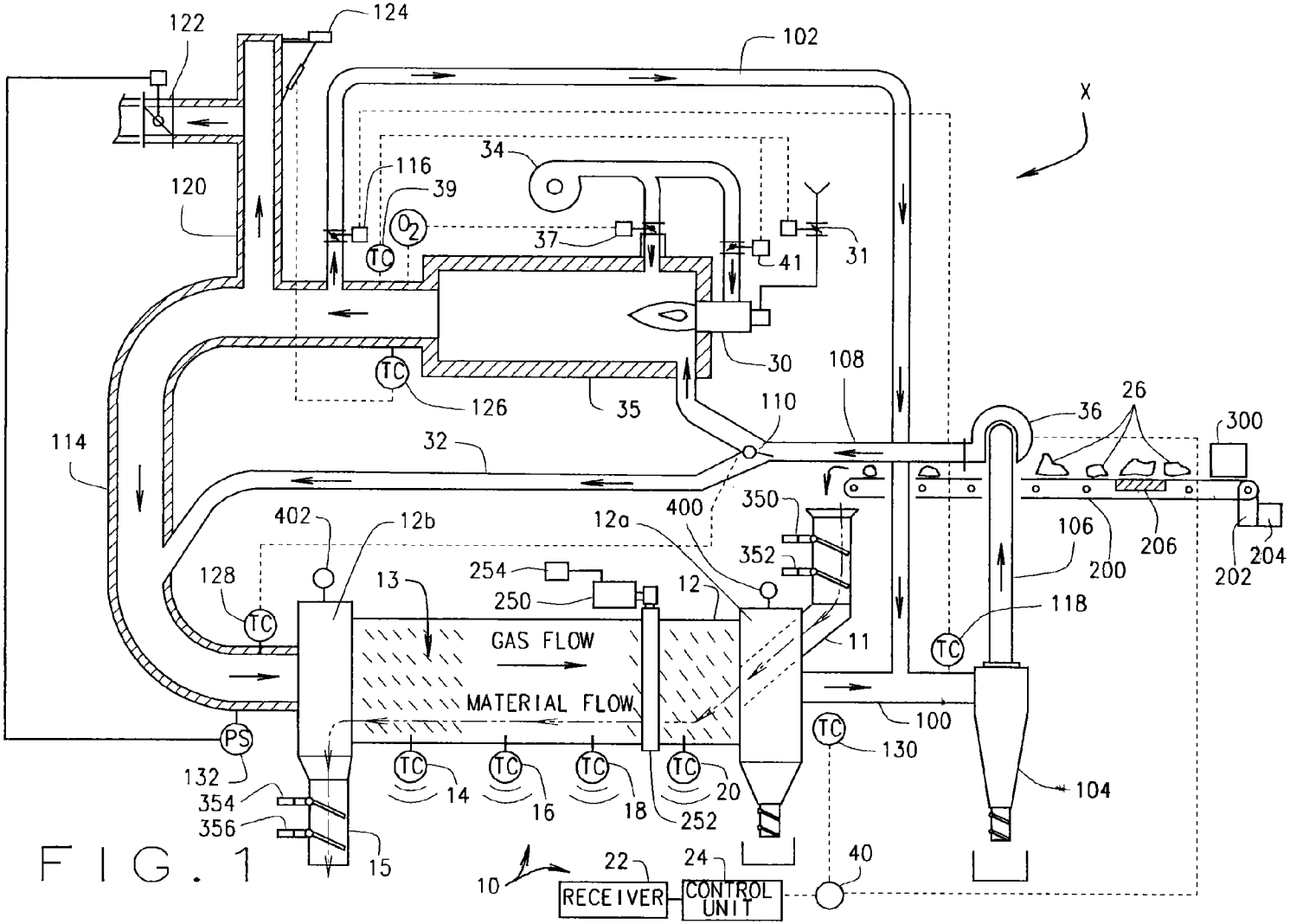
FIG. 1 is a schematic of an aluminum rotary kiln delacquring system incorporating one embodiment of the present invention.

In referring to the drawings, a schematic embodiment of the novel wireless temperature sensing and control system of the present invention is shown generally at 10 in FIG. 1, where the present invention is depicted by way of example as integrated into a representative mass flow delacquering system X with a rotary aluminum kiln 12 having a delacquering Zone 13 within the kiln 12. As can be seen, a set of four wireless high temperature thermocouples 14, 16, 18 and 20, are positioned along the length of the kiln 12, with each associated with a different operational Zone within the kiln 12. In particular, the thermocouple 20 is associated with Zone #1, in which the kiln 12 heats used beverage container ("UBC") material in the kiln 12 to approximately 300 degrees Fahrenheit to evaporate any moisture in the material. Next, the thermocouple 18 is associated with Zone #2, in which the kiln 12 heats UBC material in the kiln 12 to approximately 700 degrees Fahrenheit to volatize the coatings and other polymers in the material. Next, the thermocouple 16 is associated with Zone #3, in which the kiln 12 heats UBC material in the kiln 12 to approximately 900 degrees Fahrenheit to carbonize any residual coatings and other polymers. Finally, the thermocouple 14 is associated with Zone #4, in which the kiln 12 heats UBC material in the kiln 12 to approximately 1000 degrees Fahrenheit to remove residual ash from the material to form finished delacquered material, known in the industry as "bright" quality.

In practice, the thermocouples 14, 16, 18 and 20 are positioned with at least the temperature sensing portion of the thermocouple exposed to the delacquering Zone 13 within the rotary kiln 12. All of the thermocouples 14, 16, 18 and 20 are configured to detect temperature readings in the kiln 12, including temperature readings in excess of the melting point of aluminum, and are further configured to transmit the temperature readings they sense inside of the kiln 12 via radio signals to a receiving device or receiver 22 that is external of the kiln 12. Alternately, the thermocouples 14, 16, 18 and 20 could be operatively connected to a wireless transmitter (not shown) that would transmit the temperature readings to the receiving device or receiver 22.

Aluminum feed material (also known in the industry as "shreds") 26, which is not a part of either of the systems 10 or X but which is ready for the delacquering process, is supplied to the kiln 12 through a feed material chute 11, which controllably regulates the rate at which the feed material is supplied to the inlet end of the kiln 12. The feed material 26 is discharged through a controllable discharge chute 15 positioned at the opposite end of the kiln 12 from the feed chute 11, and positioned lower than the feed chute 11. Although not depicted in FIG. 1, the kiln 12 is oriented at an incline with respect to the ground such that the end of the kiln 12 nearest the chute 11 is elevated above the height of the end of the kiln 12 nearest the chute 15. In addition, the inner surface of the kiln 12 has flights or ridges (not shown) in proximity to the chute 11 to facilitate the movement of the feed material 26 away from the chute 11 and into the kiln 12. In addition, further away from the chute 11, the inner surface of the kiln 12 has louvered flights or ridges (not shown) that are adapted to pick up the feed material 26 and drop it through the center of the kiln 12 as the kiln 12 rotates about its axis. This allows the system X to operate in an assisted gravity-feed mode. In some delacquering system configurations, the kiln 12 may have threaded ridges constructed along its inner surface that are adapted to direct the feed material 26 through the kiln 12 from the feed chute 11 to the discharge chute 15.

By limiting the amount of material that can pass through it, the discharge chute 15 can controllably regulate the rate at which feed material 26 is discharged from the kiln 12. In order to reach and maintain temperatures sufficient to delacquer the aluminum feed material 26 in the depicted delacquering system X, the kiln 12 receives heated air from a burner 30 and a burner bypass pipe 32. The burner 30 receives ambient temperature air, at a temperature of approximately 70 degrees F., from a combustion blower 34 and recirculated gases, at a temperature of approximately 500 degrees F., from a variable speed recirculation blower 36 which in turn receives the recirculated heated gases that have passed through the kiln 12. Combustion gases are controllably supplied to the burner 30 through a mass flow controller 31. The combustion blower 34 also drives the ambient temperature air into an afterburner 35 attached to the burner 30. Oxygen can be controllably injected as desired directly into the afterburner 35 through a mass flow controller 37. A thermocouple 39 positioned near the exit for the afterburner 35 takes temperature readings of the gases as they exit the afterburner. The thermocouple 39 connects to the combustion gas mass flow controller 31 and a mass flow controller 41, positioned between the combustion blower 34 and the burner 30, such that the mass flow controllers 31 and 41 regulate the flow of combustion gases and air, respectively, in response to the temperature readings from the thermocouple 39, so as to automatically control the burner 30 to control the temperature of the gases supplied to the kiln 12 through a supply pipe 114. A first kiln hood 12*a* connects the chute 11 to the kiln 12 and an outlet kiln hood 12*b* connects the kiln 12 to the chute 15 and the supply pipe 114.

Because the recirculation blower 36 simultaneously supplies preheated air to the burner 30 and the kiln 12, the volume of heated air supplied to the kiln 12 in delacquering system X can be predictably controlled by varying the speed of the blower 36. Because the volume of heated air supplied to the kiln 12 in turn affects the amount of heat injected into the kiln 12 and thereby across the feed material 26 in the delacquering Zone 13 within the kiln 12, varying the speed of the blower 36 has a controllable and predictable impact on the amount of heat applied to the feed material 26 in the delacquering Zone 13.

The receiver 22 is operatively connected to a programmable control unit 24, although in other configurations the control unit 24 can comprise the receiver 22. Of course, wires or wireless devices may alternatively be used to operatively connect components positioned outside the kiln 12 or outside the gas and material flow components of the system X. Hence, for example, the receiver 22 may be wired to or wirelessly connected to the control unit 24. The kiln temperatures transmitted from the thermocouples 14, 16, 18 and 20 to the receiver 22 are communicated to the control unit 24. In traditional configurations, an automated feedback loop adjusts the speed of the blower 36 in response to the quantity and rate of feed material directed into the kiln 12. In the present configuration of FIG. 1, the control unit 24 is operatively connected to and controls a mass flow controller 40 that regulates the speed of the recirculation blower 36, and thereby the heat applied to the feed material 26 in the delacquering Zone 13 within the kiln 12. The control unit 24 may be wired to or wirelessly connected to the mass flow controller 40. The control unit 24 automatically controls the speed of the blower 36, using commands to the mass flow controller 40, based upon a predetermined process loop control algorithm programmed into the control unit 24.

As seen in FIG. 1, in a representative mass flow delacquering system X, gases exiting the kiln 12 travel through an exit pipe 100, where a bypass pipe 102 joins the exit pipe 100. The temperature of the gases traveling in this area of the system X is approximately 500 degrees F. The gases are then directed into a cyclone 104, through an inlet pipe 106 into the recirculating blower 36. The blower 36 both draws the gases from the cyclone 104 and pushes the gases into supply pipe 108. A diverter valve 110 is positioned at a junction along the pipe 108 to direct the gas flow into an afterburner 35 or through the burner bypass pipe 32. Gases directed into the afterburner 35 are subjected to the heat generated by the burner 30, where the gas temperature is raised to approximately 1500 degrees F. The gases are then directed out of the afterburner 35 and directed along the supply pipe 114 to the kiln 12.

Near the afterburner 35, the bypass pipe 102 is connected to the supply pipe 114, where a portion of the gases are diverted to the exit pipe 100. The amount of gas that is allowed to exit through the bypass pipe 102 is controlled by a bypass valve 116. The bypass valve 116 is, in turn, connected to a thermocouple 118 in the exit pipe 100, and the valve 116 opens and closes in response to the temperature readings supplied by the thermocouple 118.

Downstream from the junction of the bypass pipe 102 and the supply pipe 114, a vent pipe 120 joins the supply pipe 114. The vent line connects to a pressure control damper 122 and, through which the gas pressure in the system X can be controlled. In addition, an emergency vent stack 124, that is triggered by temperature readings supplied from a thermocouple 126 in the supply pipe 114 near the exit for the afterburner, connects to the vent pipe to provide for a safety pressure relief for the system X.

Before entering the kiln 12, the supply pipe 114 is joined by the burner bypass pipe 32. By utilizing the diverter valve 110 to controllably combining the higher temperature gases supplied by the afterburner with the lower temperature gases supplied by the bypass 32, the user can regulate the temperature of the gases supplied to the kiln 12. A nominal target temperature for a typical delacquering operation is approximately 1100 degrees F. The diverter valve 110 is connected to a thermocouple 128 in the supply pipe 114 near the entrance to the kiln 12, and the valve 110 rotates to control the ratio of gases directed into the afterburner 35 as opposed to the bypass 32, in response to the temperature readings supplied by the thermocouple 128.

A thermocouple 130 near the junction of the kiln 12 and the exit pipe 100 takes temperature readings of the gases as they exit the kiln 12. This temperature data provides an additional source of information to alternatively control the mass flow controller 40. The temperature readings from thermocouple 130 may be used separate from or in conjunction with the operation of the control unit 24.

A pressure sensor 132 is positioned in the supply pipe 114 near the entrance to the kiln 12. The pressure sensor 132 is connected to and controls the pressure control damper 122 in the vent stack 120.

Upon initial setup, the wireless thermocouples 14, 16, 18 and 20 can be used to profile the temperatures along the inner length of the kiln 12. This profile is then programmed into the control unit 24 as a baseline from which overtemp events are detected and to which a response is performed. During operation of the system X, the control unit 24 constantly and automatically monitors the kiln 12 via the temperatures received from each of the wireless thermocouples 14, 16, 18 and 20. The algorithm in the control unit 24 is programmed to use the baseline profile to monitor for spikes or unacceptable increases in temperature in the feed material 26 in the delacquering Zone 13 within the kiln 12, and automatically control the heat supplied to the kiln 12 to prevent fires in the kiln 12 and otherwise maintain a proper operational delacquering profile within the kiln 12.

In a simple form, and by way of example, should any one or more of the thermocouples 14, 16, 18 and 20, detect a temperature that exceeds a predetermined high limit setpoint for a period of time that exceeds a predetermined duration, or should one or more of the thermocouples 14, 16, 18 and 20, detect an abnormal temperature pattern in the kiln 12 such as a rapid rise in temperature, the control unit 24 then automatically instructs the mass flow controller 40 to decrease the speed of the blower 36 a predetermined amount based upon the anticipated reduction in heat that is necessary to avoid a fire in the kiln 12, as formulated from tests and calculations. Should the temperatures in the kiln 12 drop below a lower limit setpoint for a period of time that exceeds a duration setpoint, the control unit 24 then automatically instructs the mass flow controller 40 to increase the speed of the blower 36 a predetermined amount based upon the anticipated increase in heat that is necessary to properly operate the kiln 12, also as formulated from tests and calculations. Of course, one skilled in the art will recognize that much more complex algorithms may be incorporated in the control unit 24 to enable refined control of the temperature profile of the feed material 13 and the and the efficiency of the kiln 12.

In an even more simplified variant of the novel wireless temperature sensing and control system for metal kiln 10 of the present invention (not shown), there is no control loop to automatically control the heat supplied to the kiln 12. Rather, when an overtemp event is identified by the control unit 24 from the wireless thermocouples 14, 16, 18 and 20, such as for example when any one or more of the thermocouples 14, 16, 18 and 20, detects a temperature that exceeds a predetermined high limit temperature setpoint for a period of time that exceeds a predetermined duration, or should one or more of the thermocouples 14, 16, 18 and 20, otherwise detect an abnormal temperature pattern in the kiln 12 such as a rapid rise in temperature, the control unit 24 generates a notification. The notification can activate a notification apparatus, such as triggering an alarm (not shown) to alert the system X operators of a potential fire threat in the kiln 12. The system X operators can then inspect the situation and make any manual or automated adjustments to the system X operation as they see fit.

It must be noted that a number of the control loops in the system 10 are "feed-forward". That is, such "feed-forward" control loops comprise at least one element or pathway within the environment of the control system that conveys a system controlling signal from a source that is an external environment external to the system, such as an external operator or device. Consequently, a control loop that has only feed-forward behavior responds to its externally derived control signal in a pre-defined way without responding to how the system process load itself reacts. In contrast, a system that utilizes inter-system feedback adjusts the process control output (i.e., controls the system) by taking into account of how command signals from within the process load itself affect that process, including how the load itself may vary unpredictably during processing. Here, for the present disclosure, the system process load concerns the operational load within the kiln 12, and nothing external to the kiln 12.

Figure 2:
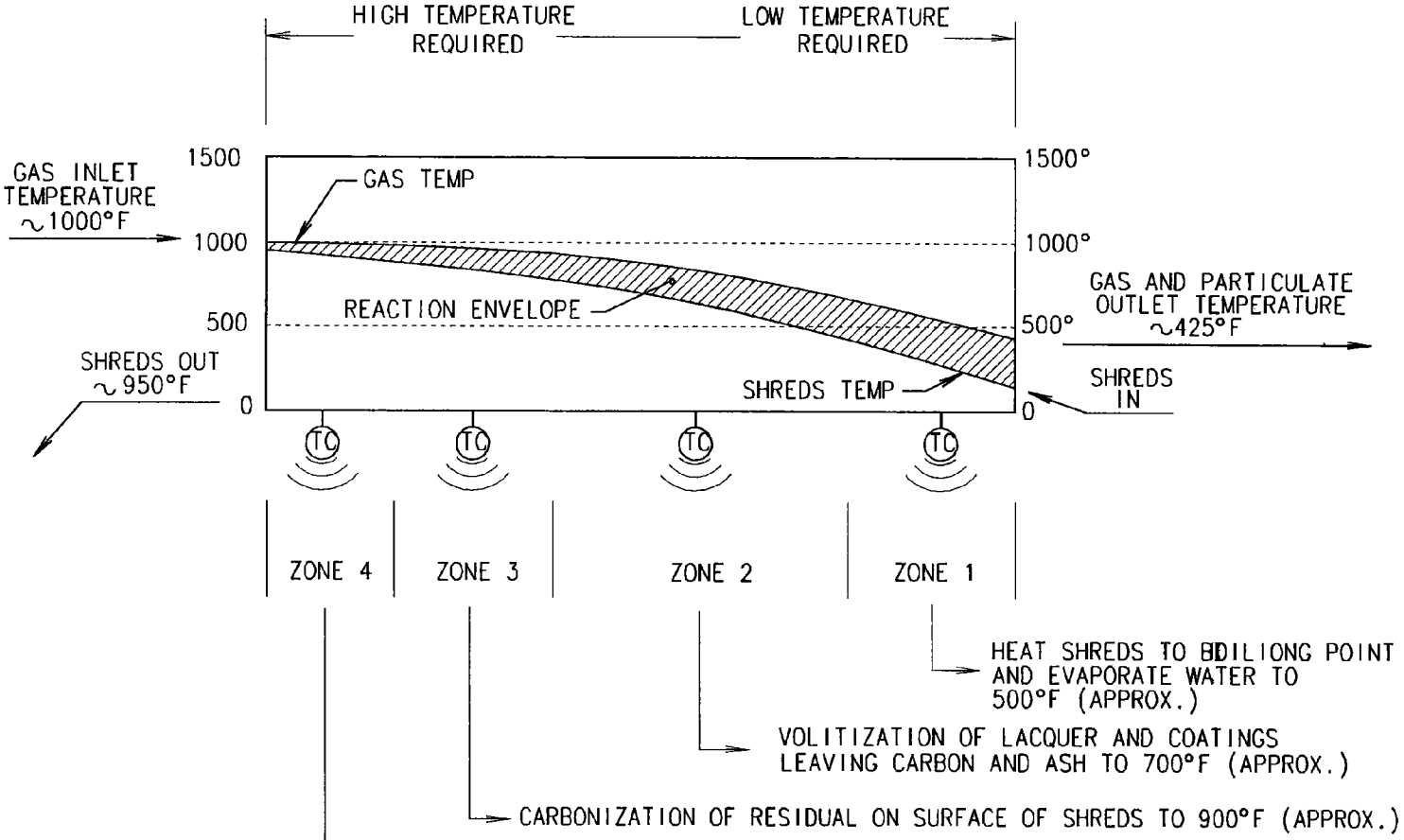
FIG. 2 is a representative schematic chart that diagrammatically shows a temperature profile and associated information for the operation of the rotary kiln of a delacquering system processing for used beverage container material, the system being controlled by an embodiment of the present invention.
Figure 3:
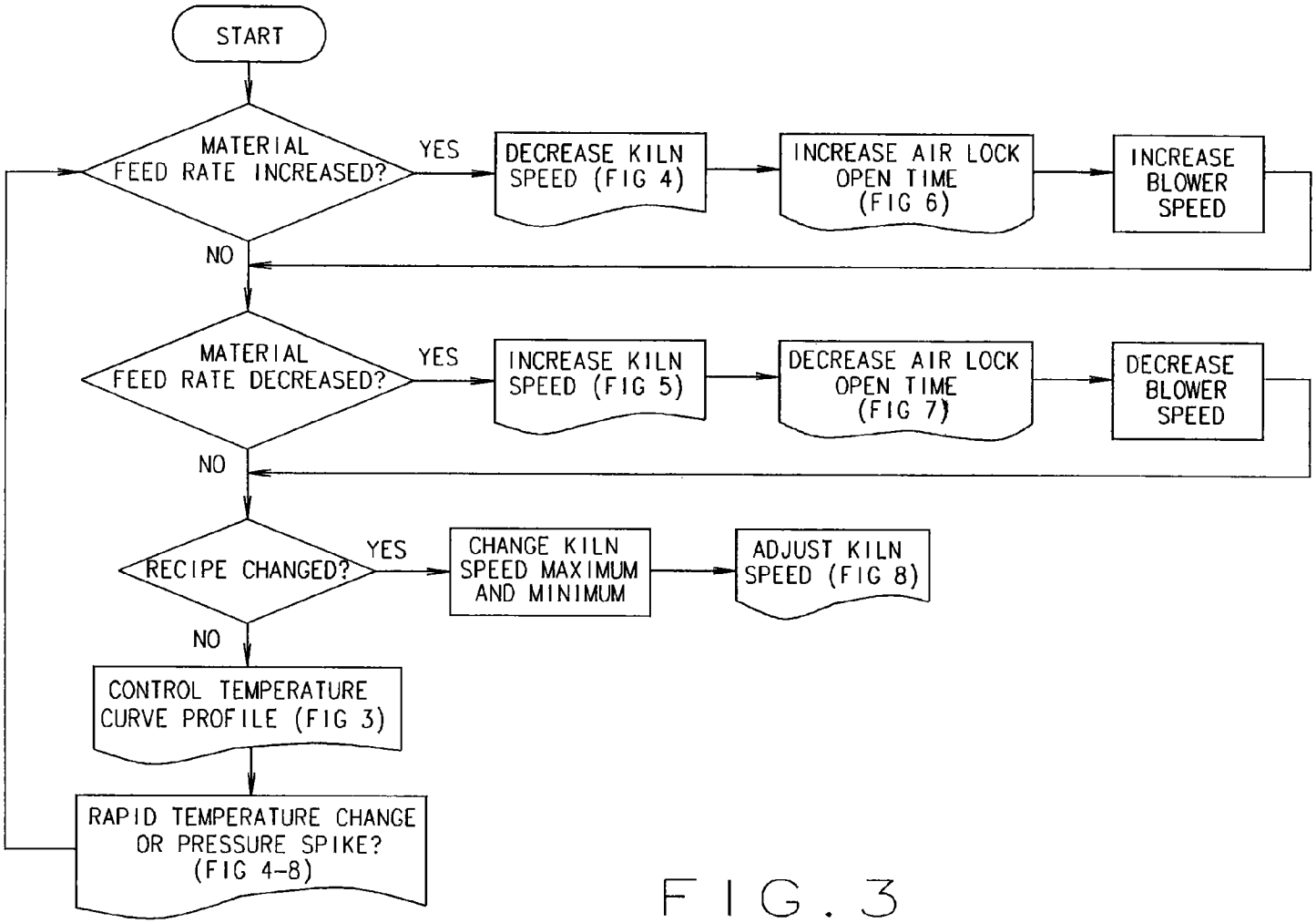
FIG. 3 is a flow diagram of a method for operational control of at least a portion of an aluminum rotary kiln delacquring system incorporating one or more embodiments of the present invention.
Figure 4:
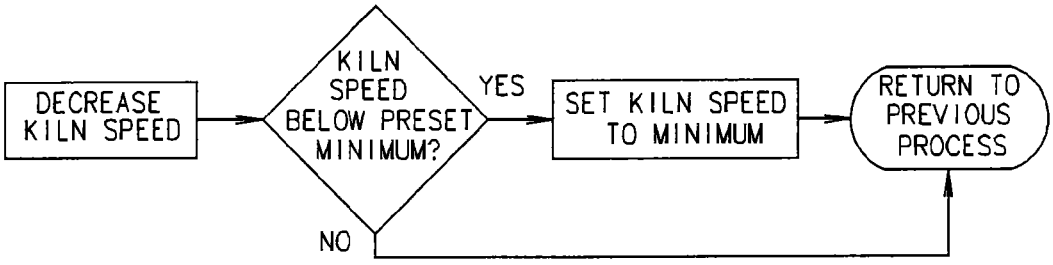
FIG. 4 is another flow diagram of a method for operational control of at least a portion of an aluminum rotary kiln delacquring system incorporating one or more embodiments of the present invention.
Figure 5:
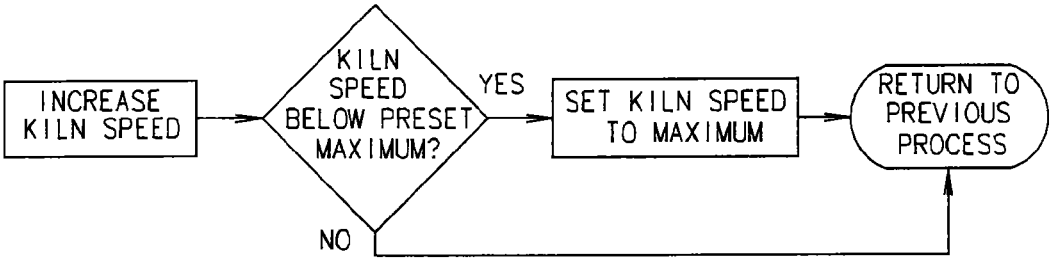
FIG. 5 is yet another flow diagram of a method for operational control of at least a portion of an aluminum rotary kiln delacquring system incorporating one or more embodiments of the present invention.
Figure 6:
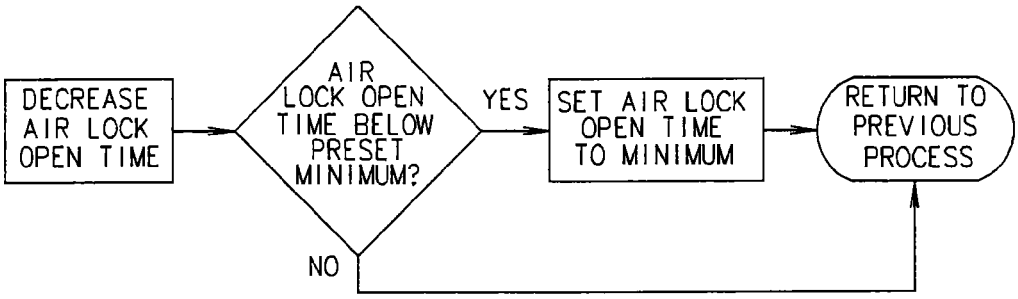
FIG. 6 is yet another flow diagram of a method for operational control of at least a portion of an aluminum rotary kiln delacquring system incorporating one or more embodiments of the present invention.
Figure 7:
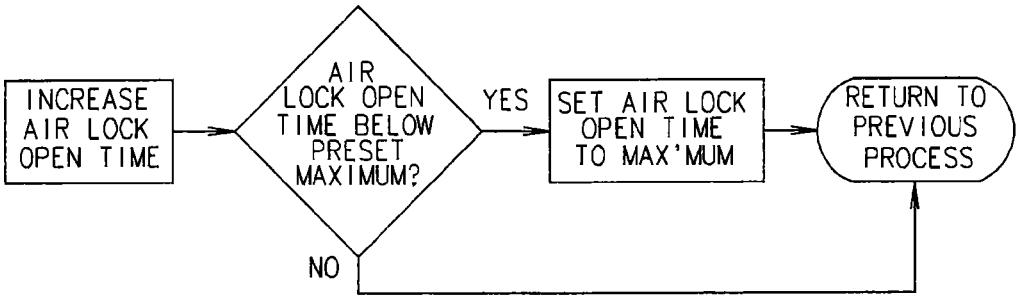
FIG. 7 is yet another flow diagram of a method for operational control of at least a portion of an aluminum rotary kiln delacquring system incorporating one or more embodiments of the present invention.
Figure 8:
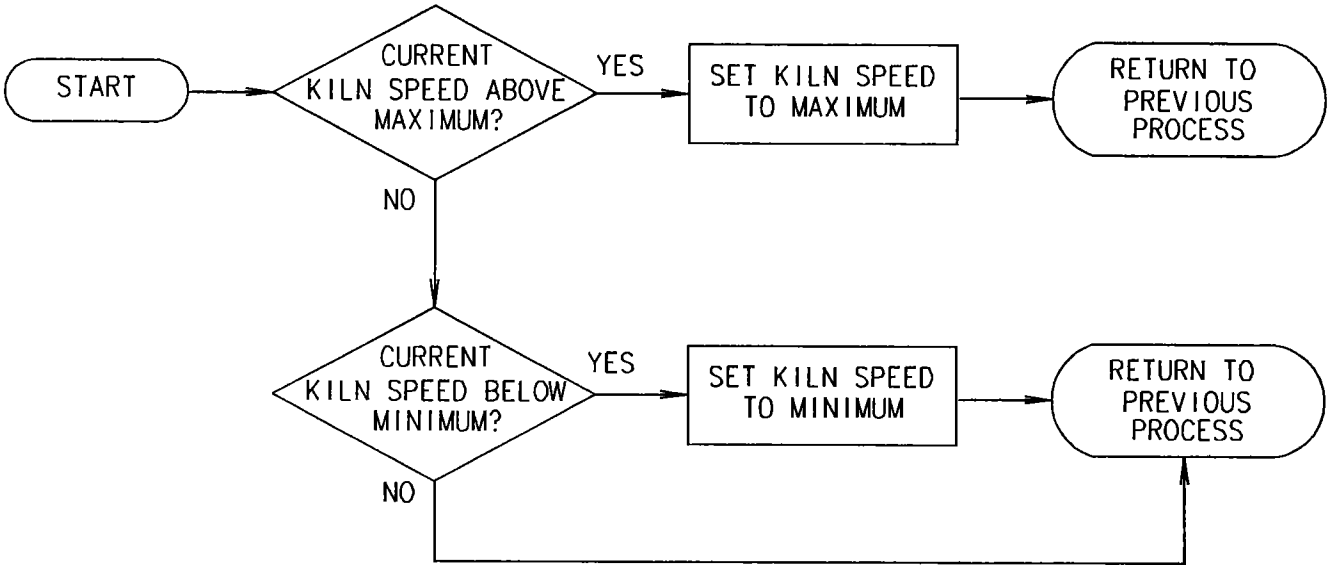
FIG. 8 is yet another flow diagram of a method for operational control of at least a portion of an aluminum rotary kiln delacquring system incorporating one or more embodiments of the present invention.
Figure 9:
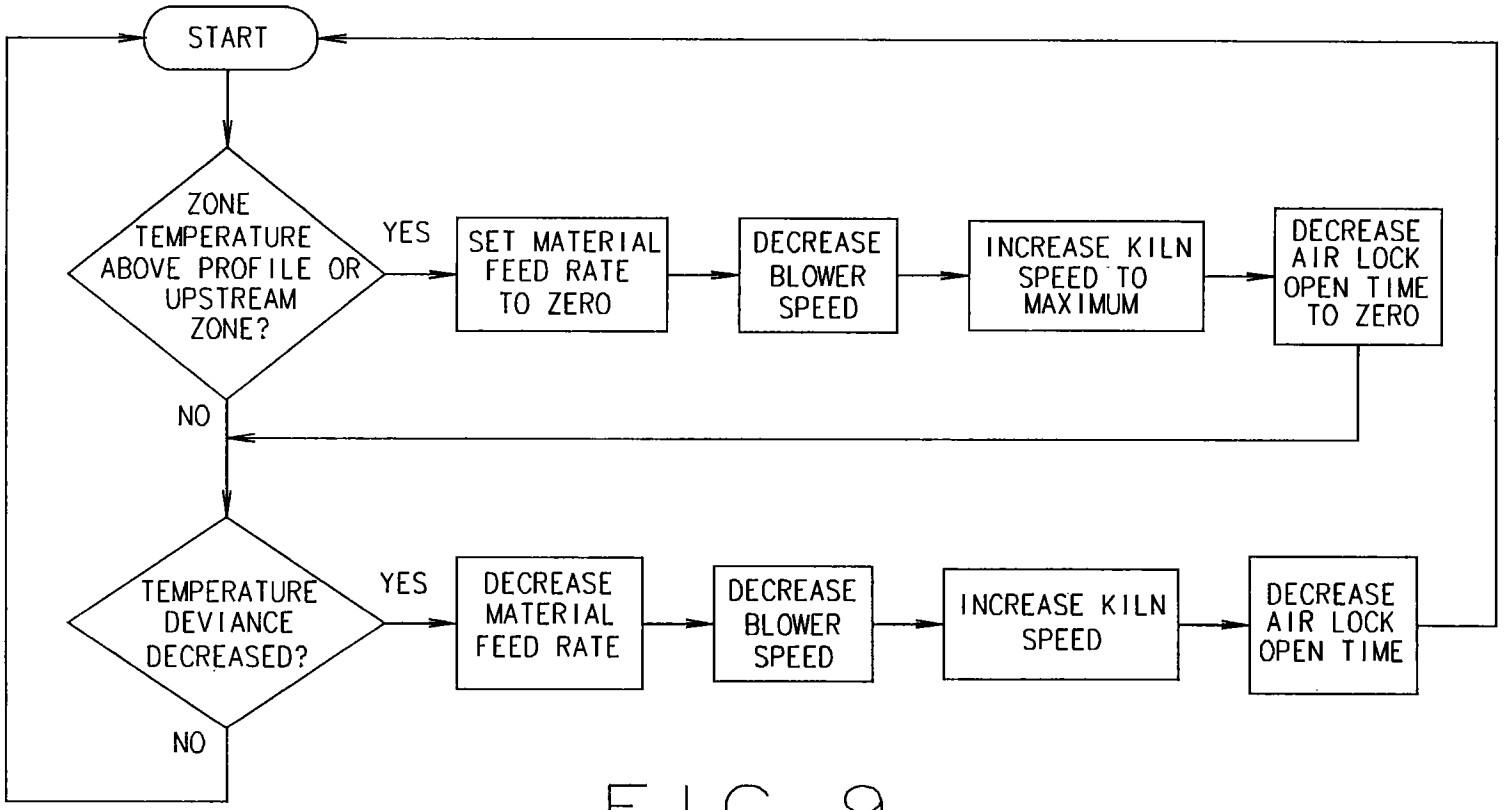
FIG. 9 is yet another flow diagram of a method for operational control of at least a portion of an aluminum rotary kiln delacquring system incorporating one or more embodiments of the present invention.
Figure 10:
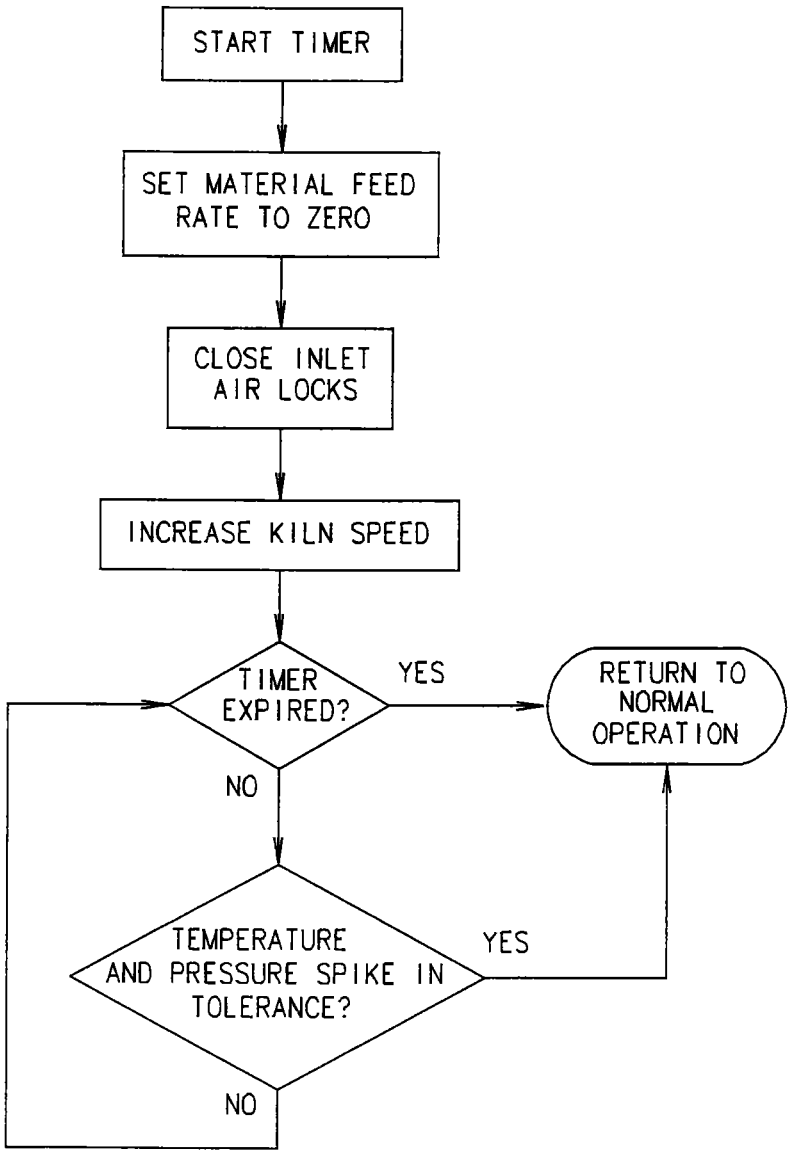
FIG. 10 is yet another flow diagram of a method for operational control of at least a portion of an aluminum rotary kiln delacquring system incorporating one or more embodiments of the present invention.

Referring to FIG. 2, a temperature curve profile is presented for the delacquering of feed material 26 comprising UBC that is being processed through the kiln 12 in a steady state. This profile is then used as the basis for the control system 10 to control the system X to process the UBC feed material through the kiln 12. Each of the thermocouples 14, 16, 18 and 20 is monitored and check to see if it is sensing temperatures above or below its Zone temperature profile. In addition, each Zone is compared to each other and if the profile curve begins to flatten, or in other words if the predefined temperature deviance decreases, the control unit 24 will take the following actions in a variable control response. The material feed rate is reduced in an incremental rate, essentially reducing the volume of mass that is in the kiln 12; this reduction of feed "mass" is used as a feed forward control for the recirculation blower 36 and will reduce the speed of the recirculation blower 36 accordingly to thereby reduce the volume and velocity of the process air forced through the kiln 12 by the recirculation blower 36. The material feed rate is the control input for the kiln rotation speed variable frequency drive 254 and will increase the speed of the kiln rotation to allow the material "mass" to move through the kiln 12 faster. The material feed rate also controls the speed at which the material inlet air locks 352 and 354 operate. As the feed rate decreases the air locks 352 and 354 will slow down to compensate. This has the effect of decreasing the amount of oxygen that enters the kiln 12 from the actions of the air locks opening to the kiln 12, thereby providing tighter control of the amount of oxygen control within the kiln 12. All other control loops in the system 10 will run as originally designed and will react accordingly to process conditions.

In the event that a Zone's temperature profile has a deviance goes above the upper limit of its profile or that of the next Zone upstream, the system 10 will shut off the supply of feed material 26 completely. This will cause the recirculation blower 36 to slow accordingly and kiln speed to increase to its maximum. The material feed inlet air locks 352 and 354 will close. All other control loops in the system will run as originally designed and will react accordingly to process conditions.

Certain upset conditions can occur within the kiln; the two most prevalent and monitored are described below:

Upset condition #1: Most incursions are the result of highly volatile material mistakenly entering the process environment. This can be anything with a large calorific value such as rubber, plastics, oils, or items with high percent of coating that exceed design parameters. These upset conditions normally happen between Zone #1 and #2 and happen very rapidly.

Upset condition #2: Excessive amounts of fines and minute aluminum partials. These small aluminum partials are slow to travel through the kiln from end to end, due to the low mass not being able to overcome the pressure and velocities of the process gasses entering the kiln on the discharge side of the kiln. Due to time and temperature in the kiln these partials oxidize and become a combustible metal. The more aluminum oxides that form; the greater chance for the mass in the kiln to auto combust into a flash fire. This upset condition normally happens between Zone #3 and #4 and happens very rapidly.

Extra measures are taken in the control unit to monitor temperature and pressure changes between these Zones and kiln hoods to control the listed upset conditions. If a rapid change in temperature is seen in Zone #1 & #2, and Zones #3 and #4 compared to steady state conditions or a sudden pressure hood spike, the system will react in an expedited fashion. By stopping feed, stopping the inlet air locks, speeding up the kiln RPM, for a predetermined amount of time or until Zone temperatures lower to within or below its temperature profile. Once the upset condition has subsided the control unit will return to normal operations.

In the event the upset condition is only a pressure spike within the hoods, the system will react in the same fashion as describe above but for a predetermined time only.

In alternate embodiments of the control system 10 as adapted to a delacquering system such as X, the control system 10 may be adapted to incorporate any one or more of each of the following six system control loops, or the system 10 may include all six:

1. Material Feed Rate Control Loop

As can be seen from FIG. 1, the feed material 26 is fed into the feed chute 11 by a conveyor belt 200 that is operated by a motor 202. A variable speed drive 204 controls the rotational speed of the motor 202, which in turn dictates that speed of the conveyor belt 200 and the rate at which the feed material 26 is fed by the conveyor belt 200 into the chute 11. A weight load sensor 206 is positioned between the feed and return portions of the conveyor belt 200 such that the sensor 206 senses and determines the weight or mass of the feed material 26 passing over the sensor 206 as the feed material 26 is fed by the conveyor belt 200 into the chute 11. The control unit 14 controls the speed of the motor 202 by controlling the variable speed drive 204. Through the control unit 24, the user can set a lone predetermined set point for a specific feed rate, set a schedule of predetermined feed rates, or program an algorithm to set a varying feed rate, all as may be desired by the user.

The control unit 24 receives input from the load sensor 206, which allows the control unit 24 to promptly calculate the rate at which the feed material 26 is being fed into the kiln 12 from the chute 11 on an ongoing basis. When input from the sensor 206 informs the control unit 24 that the feed rate is increasing beyond the predetermined set point, the control unit instructs the motor 202 to slow and thereby decrease both the speed of the conveyor belt 200 and feed rate of feed material 26 into the chute 11. Conversely, when input from the sensor 206 informs the control unit 24 that the feed rate is decreasing below the predetermined set point, the control unit instructs the motor 202 to speed up and thereby increase both the speed of the conveyor belt 200 and feed rate of feed material 26 into the chute 11. The control unit 24 thereby maintains a controls the feed rate to maintain a consistent feed into the chute 11 based on the predetermined set point selected by the user.

2. Feed Rate Kiln Rotation Speed Control Loop

The kiln 12 is rotated by a motor 250 that operatively engages a circumferential ring 252 formed about the outer perimeter of the kiln 12. In alternate embodiments, the motor 250 may be linked to the kiln 12 by variety of alternate combinations of engagement devices, such as for example, gearboxes, chains and/or sprockets, depending upon the configuration of the system X. A variable speed drive 254 controls the speed of the kiln rotation motor 250, and in turn the control unit 24 controls the variable speed drive 254. In the present embodiment, the control unit 24 utilizes an internally programmed proportional-integral-derivative ("PID") control loop 24*a* to operate the rotation of the kiln 12. The PID control loop 24*a* has preprogramed maximum and minimum rotational speed limits for the motor 250. The control unit 24 receives input from the load sensor 206 that allows the control unit 24 to calculate the feed rate of feed material 26 into the chute 11, which provides the feed rate at which the feed material 26 is being fed into the kiln 12. Alternately, the system 10 can be configured such that the control unit 24 receives input from a sensor in the chute 11 (not shown) to inform the control unit 24 of the feed rate in the chute 11.

When the sensor 206 informs the control unit 24 that the feed rate is increasing, the PID control loop 24*a* instructs the motor 250 to slow and thereby decrease the rotation of the kiln 12. This allows the larger amount or mass of feed material 26 additional time to react with the process gases in the kiln 12. Conversely, when input from the sensor 206 informs the control unit 24 that the feed rate is decreasing, the PID control loop 24*a* instructs the motor 250 to speed up and thereby increase the rotation of the kiln 12. This compensates for the lesser amount or mass of feed material 26 being processed through the kiln 12, which reduces wasted process time, energy and fuels, and thereby increases the efficiency of the delacquering system X.

3. Feed Material Type Kiln Rotation Speed Control Loop

The control unit 24 may be configured to be programmed with an algorithm or recipe that varies the rotational speed of the kiln 12 based upon variations in material type and/or density. As can be appreciated, differing material types may have differing requirements for the rotational speed of the kiln 12, which alters the time the material is in the kiln 12. In this embodiment, a material determination system 300 is placed in association with the conveyor belt 200 such that the material determination system 300 can operate to ascertain the type of feed material being fed into the chute 11 along the conveyor belt 200.

The control unit 24 receives input from the material determination system 300 that allows the control unit 24 to calculate the appropriate feed rate of the feed material 26 into the chute 11, which provides the rate at which the feed material 26 is being fed into the kiln 12. The control unit 24 then utilizes the PID control loop 24*a* to instruct the motor 250 to slow down or speed up as necessary to control the rotation of the kiln 12 to its proper level as determined by the control unit 24 for the type of feed material being fed into the chute 11, all in response to the input from the material determination system 300.

4. Feed Material Inlet Air Lock Open/Close Rate Control Loop

The chute 11 has an upper controllable air lock 350 and a lower controllable air lock 352. The air locks 350 and 352 are designed to minimize the escape of gases from the kiln 12 and provide another means to regulate the flow of feed material 26 into the kiln. In this regard, the air locks 350 and 352 are timed such that when feed material 26 enters the top of the chute 11, the upper air lock 350 opens while the lower air lock 352 remains closed. When a sufficient period of time has passed to partially fill, but not overfill, the space between the air locks 350 and 352 in the chute 11, the upper air lock 350 closes. After the upper air lock 350 has closed, the lower air lock 352 opens to allow the feed material 26 between the two air locks to drop down the chute 11 and into the kiln 12. The lower air lock 352 then closes and the cycle is ready to begin again.

Similarly, the chute 15 has an upper controllable air lock 354 and a lower controllable air lock 356. The air locks 354 and 356 are also designed to minimize the escape of gases from the kiln 12 and provide another means to regulate the flow of feed material 26 into the kiln. In this regard, the air locks 354 and 356 are timed such that when feed material 26 enters the top of the chute 15 from the kiln 12, the upper air lock 354 opens while the lower air lock 356 remains closed. When a sufficient period of time has passed to partially fill, but not overfill, the space between the air locks 354 and 356 in the chute 15, the upper air lock 354 closes. After the upper air lock 354 has closed, the lower air lock 356 opens to allow the feed material 26 between the two air locks to drop down the chute 15 and away from the kiln 12. The lower air lock 356 then closes and the cycle is ready to begin again.

Each of the air locks can be controlled to set the rate at which they open and close, as well as the period of time that they remain open or closed. All of the air locks 350, 352, 354 and 356 can be adapted to be operatively associated with the control unit 24 such that control unit 24 controls the rate at which each opens, closes, remains open and remains closed. In so controlling the air locks 350 and 352, the control unit 24 regulates the rate at which the feed material 26 enters the kiln 12. Similarly, in so controlling the air locks 354 and 456, the control unit 24 regulates the rate at which the feed material 26 is able to exist the kiln 12. Based upon its programming, the control unit 24 determines the appropriate values to set for each operational control parameter for each of the air locks 350, 352, 354 and 356. In addition, again depending upon programming, and depending upon changing conditions inside and outside the kiln 12, and those values can be varied during processing.

5. Feed Rate Controlled Recirculation Fan Control Loop

The recirculation blower 36 can be adapted to utilize a feed forward control based upon the feed rate of the feed material 26. In this configuration, the control unit 24 is configured to receive input from the load sensor 206 associated with the feed material conveyor belt 200, which allows the control unit 24 to promptly calculate the rate at which the feed material 26 is being fed into the kiln 12 from the chute 11 on an ongoing basis. When input from the sensor 206 informs the control unit 24 that the feed rate is increasing, the control unit 24 instructs the recirculation blower 36 to increase in speed to accommodate the increase in feed material entering the kiln 12. Conversely, when input from the sensor 206 informs the control unit 24 that the feed rate is decreasing, the control unit 24 instructs the recirculation blower 36 to slow down and thereby reduce the rate of flow of the heat across the feed material 26 in the kiln 12.

6. Kiln Hood Pressure Control Loop

Two pressure sensors 400 and 402 can be installed in the inlet kiln hood 12*a* and the outlet kiln hood 12*b*, respectively, to measure the pressure differential between each of the kiln hoods, 12*a* and 12*b*, and atmospheric pressure. The sensors 400 and 402 are each operatively associated with the control unit 24 such that should either sensor detect a pressure, a rise in pressure, or a pressure pattern, that the control unit 24 has been programmed to recognize as dangerous or otherwise undesirable, the control unit 24 can then implement changes in the operation of the system X in response.

Of course, one of ordinary skill in the art will recognize that additional manual and emergency override controls and systems can be incorporated in or added to the control system X and/or the delacquering system, such as X, to further minimize the risk of system failures or hazardous conditions.

In addition, the programmable control unit 24 may be operatively connected to and control in response to the temperature readings from any one or more of the thermocouples 14, 16, 18 and 20, any one or more of the heat flow control devices in the system X, which include for example and without limitation, the pressure control damper 122, the combustion blower 34, the combustion oxygen supply mass flow controller 37, the combustion gas mass flow controller 31, the combustion air mass flow controller 41, the diverter valve 110, the emergency vent 124, the bypass valve 116, the feed material control chute 13 and the feed material discharge chute 15.

While we have described in the detailed description two configurations that may be encompassed within the disclosed embodiments of this invention, numerous other alternative configurations, that would now be apparent to one of ordinary skill in the art, may be designed and constructed within the bounds of our invention as set forth in the claims. Moreover, both of the above-described novel wireless temperature sensing and control system for metal kiln 10 of the present invention can be arranged in a number of other and related varieties of configurations without expanding beyond the scope of our invention as set forth in the claims.

For example, the system 10 is not necessarily required to be installed in a mass flow delacquering system X as depicted in FIG. 1, but may be installed or otherwise incorporated into a variety of configurations of metal recycling furnace and kiln systems. Further, the system 10 is not constrained to the use of four wireless thermocouples such as 14, 16, 18 and 20. Rather, the system 10 may comprise any number of wireless thermocouples (or other temperature sensing devices), from as few as a single wireless thermocouple up to numerous more than four wireless thermocouples. Likewise, the system 10 is not restricted to a single receiver 22 or a single control unit 24. Depending on the configuration of the recycle system and rotary kiln application, the system 10 may require or it may be desirable to utilize two or more receivers, such as the receiver 22, or two or more control units, such as the control unit 24. In addition, the system 10 is not restricted to using thermocouples, but may utilize any form of temperature sensing device that can be adapted for use in the furnace or kiln environment for which the system 10 is designed.

By way of further example, depending on the configuration of the melt system, it may be necessary or otherwise desirable to include in the system 10 one or more mass flow controllers or other such heat flow control devices in the recycle system X that are capable of adjusting the heat flow in the kiln 12. These other heat flow control devices may be positioned at various locations in the recycle system. Such heat flow control devices may include, for example, a cooling injection port, controllers for various gas supply lines to one or more burners in the melt system, and mechanical in-line dampers for gas flow. It would be recognized by one of ordinary skill in the art that any mechanism that can be manipulated to control the heat flow in the kiln 12 may potentially be incorporated into the system 10. Each of these heat flow control devices can be operatively connected to the control unit 24 such that the control unit 24 regulates the heat flow control devices in response to the temperature readings transmitted to the control unit 24 from the thermocouples 14, 16, 18 and 20. Further, the control unit 24 can be programmed to regulate the heat flow control devices in varying patterns depending on the profile of the temperature readings across the thermocouples 14, 16, 18 and 20, and the durations of those temperature readings at or about any one or more predetermined temperature set points.

Additional variations or modifications to the configuration of the novel wireless temperature sensing and control system for metal kiln 10 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of our invention.

What is claimed is:

1. A computerized control system for operating a material processing apparatus comprising a rotary kiln, the kiln having an inlet for supplying material to the kiln at a feed rate for processing of the material in the kiln, an outlet for removal of the material from the kiln after processing, and a process region positioned there between through which the material moves, the process region having a plurality of operational zones therein, each operational zone having an average zone temperature, the control system comprising:

a. a computer processor;

b. a memory unit operatively associated with the computer processor, the memory unit storing a temperature control profile comprising a plurality of temperature designations corresponding to at least two of said plurality of average zone temperatures in the process region;

c. a temperature sensor operatively associated with the computer processor; the temperature sensor measuring the average zone temperature in each of said plurality of operational zones in the process region, generating one or more signals indicative of the temperatures so measured, and communicating said one or more signals to the computer processor; and d. a plurality of process control loops, each control loop of said plurality of process control loops being operatively associated with the computer processor and being adapted to regulate at least in part the average zone temperature in one or more of said plurality of operational zones in the process region, wherein the computer processor is programmed with a set of computer operational instructions that generate a comparison between the plurality of temperature designations of the temperature control profile and the temperatures indicated by the one or more signals from the temperature sensor for the corresponding at least two average zone temperatures of said plurality of operational zones, the computer processor selecting one or more control loops from said plurality of process control loops in response to said comparison and controlling said selected one or more control loops to regulate the at least two average zone temperatures in the plurality of operational zones to substantially match their corresponding temperature designations from the temperature control profile.

2. The control system of claim 1, further comprising a plurality of temperature sensors, each temperature sensor of said plurality of temperature sensors being operatively associated with the computer processor, measuring the average zone temperature from a different of said plurality of operational zones in the process region of the kiln, generating one or more signals indicative of the temperatures so measured, and communicating said one or more signals to the computer processor, and wherein the set of computer operational instructions generate a comparison between the plurality of temperature designations of the temperature control profile and the temperatures indicated by the one or more signals from the plurality of temperature sensors for the corresponding average zone temperatures of said plurality of operational zones, the computer processor selecting one or more control loops from said plurality of control loops in response to said comparison and controlling said selected one or more control loops to regulate the average zone temperatures in the plurality of operational zones to substantially match their corresponding temperature designations from the temperature control profile.

3. The control system of claim 1, wherein the plurality of process control loops comprises two or more of:

i. an overtemp control loop;

ii. a material feed rate control loop;

iii. an air lock control loop;

iv. a return blower speed control loop;

v. a kiln rotation speed control loop;

vi. a return gas diverter control loop;

vii. an exhaust valve control loop;

viii. an oxygen control loop; and ix. a feed material type control loop.

4. The control system of claim 3, wherein the overtemp control loop comprises:

a. a feed rate regulator in communication with the computer processor, the feed rate regulator controlling the feed rate in response to instructions from the computer processor;

b. a blower having a controllable blower speed to direct process gases into the kiln at a rate determined in part by said blower speed, a blower monitor in communication with the computer processor and which measures the blower speed and sends a signal to the computer processor indicative of the blower speed, and a blower regulator in communication with the computer processor and which controls the blower speed in response to instructions from the computer processor; and c. a kiln drive that rotates the kiln at a controllable kiln rotation speed, a kiln rotation monitor in communication with the computer processor and which measures the rotation speed of the kiln and sends a signal to the computer processor indicative of said kiln rotation speed, and a kiln rotation regulator in communication with the computer processor and which regulates the kiln rotation speed in response to instructions from the computer processor.

5. The control system of claim 4, wherein when the temperature sensor sends a signal to the computer processor that the computer processor interprets as an overtemp condition, the computer processor implements one or more of the following actions:

a. sends a signal to the feed rate regulator to reduce the feed rate;

b. sends a signal to the blower regulator to reduce the blower rotational speed; and/or c. sends a signal to the kiln rotation speed regulator to increase the kiln rotation rate.

6. The control system of claim 3, wherein the plurality of process control loops comprises the material feed rate control loop and the material feed rate control loop comprises a feed rate monitor in communication with the computer processor, said feed rate monitor measuring the feed rate at which the material is fed into the kiln and transmitting a signal indicative of the feed rate to the computer processor; the feed rate control loop further comprising a feed rate regulator in communication with the computer processor to control the feed rate in response to instructions from the computer processor.

7. The control system of claim 6, wherein the set of computer operational instructions generate a correlation between the temperature control profile and the material feed rate measured by the feed rate monitor, the set of computer operational instructions selecting and controlling one or more control loops of said plurality of process control loops in response to said correlation and in conjunction with the comparison between the temperature control profile and the temperature sensor signal.

8. The control system of claim 3, wherein the air lock control loop comprises an air lock through which the material is fed into the kiln and which contains a controllable amount of the material therein for a controllable period of time before passing the contained material into the kiln, an air lock monitor in communication with the computer processor and which ascertains when material is contained in the air lock and sends a signal to the computer processor that indicates whether or not material is contained in the air lock, and an air lock regulator in communication with the computer processor and which controls the timing of when material is allowed into the air lock and when material is released from the air lock into the kiln in response to instructions from the computer processor.

9. The control system of claim 8, wherein the air lock comprises an inlet that is switchable between an open position in which material can enter the air lock and a closed position in which material cannot enter the air lock, an outlet that is switchable between an open position in which material can exit the air lock and a closed position in which material cannot exit the air lock, the air lock monitor detecting the position of the inlet and sending a signal to the computer processor indicative of the air lock position, the air lock monitor detecting the position of the air lock outlet and sending a signal to the computer processor indicative of the air lock position.

10. The control system of claim 9, wherein the air lock comprises a timer that measures the period of time the air lock contains the material therein and sends a signal to the computer processor indicative of the period of time measured by the timer, the air lock regulator operating the air lock to release the material contained in the air lock in response to instructions from the computer processor.

11. The control system of claim 8, wherein the set of computer operational instructions determine the timing of when material is and is not contained in the air lock, establishes a correlation between said timing and the temperature control profile, and selects and controls one or more of said plurality of control loops in response to the correlation in conjunction with the comparison between the temperature control profile and the temperature sensor signal.

12. The control system of claim 3, wherein the blower speed control loop comprises a blower having a controllable blower speed to direct process gases into the kiln at a rate determined in part by said blower speed, a blower monitor in communication with the computer processor and which measures the blower speed and to send a signal to the computer processor indicative of the blower speed, and a blower regulator in communication with the computer processor and which controls the blower rotational speed in response to instructions from the computer processor.

13. The control system of claim 12, wherein the set of computer operational instructions generates a correlation between the blower speed and the temperature control profile, and selects and controls one or more of said plurality of control loops in response to the correlation in conjunction with the comparison between the temperature control profile and the temperature sensor signal.

14. The control system of claim 3, wherein the kiln rotation speed control loop comprises a kiln drive that rotates the kiln at a controllable rotation speed, a kiln rotation monitor in communication with the computer processor and which measures the kiln rotation speed and sends a signal to the computer processor indicative of the kiln rotation speed, and a kiln rotation regulator in communication with the computer processor and which regulates the kiln rotation speed in response to instructions from the computer processor.

15. The control system of claim 14, wherein the set of computer operational instructions generates a correlation between the kiln rotation speed and the temperature control profile, selects and controls one or more of said plurality of control loops in response to the correlation in conjunction with the comparison between the temperature control profile and the temperature sensor signal.

16. The control system of claim 3, wherein the return gas diverter control loop comprises an inlet temperature sensor in communication with the computer processor and which measures the temperature at the inlet of the kiln, a blower that circulates hot waste gases exiting the process region back into the process region, an afterburner bypass that directs process gases from the kiln past the afterburner, an adjustable gas diverter that variably directs process gases from the kiln into the afterburner and into the afterburner bypass, and a diverter regulator in communication with the computer processor and which operates the diverter in response to instructions from the computer processor.

17. The control system of claim 16, wherein the set of computer operational instructions generates a correlation between the temperature at the inlet of the kiln and the temperature control profile, selects and controls one or more of said plurality of control loops in response to the correlation in conjunction with the comparison between the temperature control profile and the temperature sensor signal.

18. The control system of claim 3, wherein the exhaust valve control loop comprises a vent that expels exhaust gases from the kiln, a pressure sensor in communication with the computer processor and which measures gas pressure at the inlet of the kiln and sends a signal to the computer processor indicative of the gas pressure so measured, an adjustable valve that regulates a flow rate of the exhaust gases through the vent, and an exhaust valve regulator in communication with the computer processor and which controls the adjustable valve in response to instructions from the computer processor.

19. The control system of claim 18, wherein the set of computer operational instructions generates a correlation between the gas pressure at the inlet of the kiln and the temperature control profile, selects and controls one or more of said plurality of control loops in response to the correlation in conjunction with the comparison between the temperature control profile and the temperature sensor signal.

20. The control system of claim 3, wherein the apparatus comprises a burner, an afterburner for the burner, the afterburner having hot waste gases exiting therefrom, a burner gas line that supplies combustion gases to the burner, an afterburner gas line that supplies combustion gases to the afterburner, and an adjustable valve there between that regulates the flow of combustion gases through the burner and afterburner supply lines; and wherein the oxygen control loop comprises an oxygen sensor in communication with the computer processor and which measures the level of oxygen in the hot waste gases exiting the afterburner and sends a signal to the computer processor indicative of the oxygen level of the hot waste gases so measured, and a regulator in communication with the computer processor and which controls the adjustable valve in response to instructions from the computer processor.

21. The control system of claim 20, wherein the set of computer operational instructions generates a correlation between the level of oxygen measured in the hot waste gases and the temperature control profile, selects and controls one or more of said plurality of control loops in response to the correlation in conjunction with the comparison between the temperature control profile and the temperature sensor signal.

22. The control system of claim 3, wherein the apparatus comprises a burner, an afterburner for the burner, the afterburner having hot waste gases exiting therefrom, a burner gas line that supplies a flow of combustion gases to the burner through a first adjustable valve that regulates the flow of combustion gases to the burner from the burner gas line, an afterburner gas line that supplies a flow of combustion gases to the afterburner through a second adjustable valve that regulates the flow of combustion gases to the afterburner from the afterburner gas line; and wherein the oxygen control loop comprises an oxygen sensor in communication with the computer processor and which measures the level of oxygen in the hot waste gases exiting the afterburner and sends a signal to the computer processor indicative of the oxygen level in the hot waste gases so measured, and a regulator in communication with the computer processor and which controls the first and second burner and afterburner adjustable valves in response to instructions from the computer processor.

23. The control system of claim 22, wherein the set of computer operational instructions generates a correlation between the level of oxygen measured in the hot waste gases and the temperature control profile, selects and controls one or more of said plurality of control loops in response to the correlation in conjunction with the comparison between the temperature control profile and the temperature sensor signal.

24. The control system of claim 3, wherein the material type control loop comprises a feed rate monitor in communication with the computer processor and which measures the feed rate at which the material is fed into the kiln and transmits a signal indicative of the feed rate to the computer processor, a material determination system in communication with the computer processor and which ascertains the type of feed material being fed into the kiln and transmits a signal indicative of the material type ascertained to the computer processor, and a feed rate regulator in communication with the computer processor and which controls the feed rate in response to instructions from the computer processor.

25. The control system of claim 24, wherein the set of computer operational instructions generates a correlation between the material type and the material feed rate and the temperature control profile, selects and controls one or more of said plurality of control loops in response to the correlation in conjunction with the comparison between the temperature control profile and the temperature sensor signal.

26. The control system of claim 1, wherein the material flows through the kiln from the inlet to the outlet, and at least one process gas flows through the kiln in the opposite direction.

27. The control system of claim 1, wherein the kiln processes metal.

28. The control system of claim 27, wherein the material processing apparatus is adapted for metal delacquering.

29. The control system of claim 1, wherein the temperature sensor comprises a thermocouple.

30. The control system of claim 29, wherein the temperature sensor wirelessly communicates with the computer processor.

* * * * *